US006833164B2

(12) United States Patent
Liu

(10) Patent No.: US 6,833,164 B2
(45) Date of Patent: Dec. 21, 2004

(54) SINGLE-STEP HEAT TREATING AND SURFACE COATING ON SELF-PIERCING RIVETS

(75) Inventor: Huimin Liu, Northville, MI (US)

(73) Assignee: Ford Global Technologies, LLC., Dearborn, MI (US)

( * ) Notice: Subject to any disclaimer, the term of this patent is extended or adjusted under 35 U.S.C. 154(b) by 49 days.

(21) Appl. No.: 10/063,631

(22) Filed: May 6, 2002

(65) Prior Publication Data

US 2003/0207037 A1 Nov. 6, 2003

(51) Int. Cl.[7] ..... B05D 3/02; B05D 1/36

(52) U.S. Cl. ..... 427/383.7; 427/376.1; 427/376.6; 427/376.8; 427/380; 427/405; 427/419.1

(58) Field of Search ..... 427/376.1, 376.6, 427/383.7, 376.8, 380, 405, 419.1

(56) References Cited

U.S. PATENT DOCUMENTS

| | | | | |
|---|---|---|---|---|
| 3,841,896 A | | 10/1974 | Boggs et al. | |
| 3,899,370 A | | 8/1975 | Takahashi et al. | |
| 3,979,351 A | | 9/1976 | Sekhon | |
| 3,983,304 A | | 9/1976 | Sekhon | |
| 4,082,578 A | | 4/1978 | Evancho et al. | |
| 4,975,337 A | * | 12/1990 | Hyner et al. | 428/648 |
| 5,283,280 A | | 2/1994 | Whyte et al. | |
| 5,330,635 A | | 7/1994 | Floyd, Jr. | |
| 5,858,133 A | | 1/1999 | Keener | |
| 5,944,918 A | | 8/1999 | Keener | |
| 5,992,472 A | | 11/1999 | Maroino | |
| 6,149,790 A | | 11/2000 | Oikawa et al. | |
| 6,171,704 B1 | | 1/2001 | Mosser et al. | |
| 6,221,177 B1 | | 4/2001 | Keener | |
| 6,270,884 B1 | * | 8/2001 | Guhde et al. | 428/323 |

FOREIGN PATENT DOCUMENTS

| | | | | |
|---|---|---|---|---|
| EP | 1 045 020 A1 | | 10/2000 | |
| JP | 58-153783 | | 9/1983 | |
| JP | 9-144725 | | 6/1997 | |
| JP | 09144725 A | * | 6/1997 | F16B/19/06 |

* cited by examiner

*Primary Examiner*—Michael Barr
(74) *Attorney, Agent, or Firm*—Raymond L. Coppiellie; Brooks & Kushman, P.C.

(57) ABSTRACT

A single-step heat treating and surface coating process is provided for steel self-piercing rivets for joining 5xxx and 6xxx aluminum panels. In this process, two coats of zinc and aluminum flakes in an inorganic binder are applied to the steel rivets. After each coating, the rivets are heated to set and cure the coats and to achieve the desired microstructure and hardness level for joining 5xxx and 6xxx aluminum panels. The coating curing step combines the heat treatment with surface coating into a single-step procedure.

2 Claims, 1 Drawing Sheet

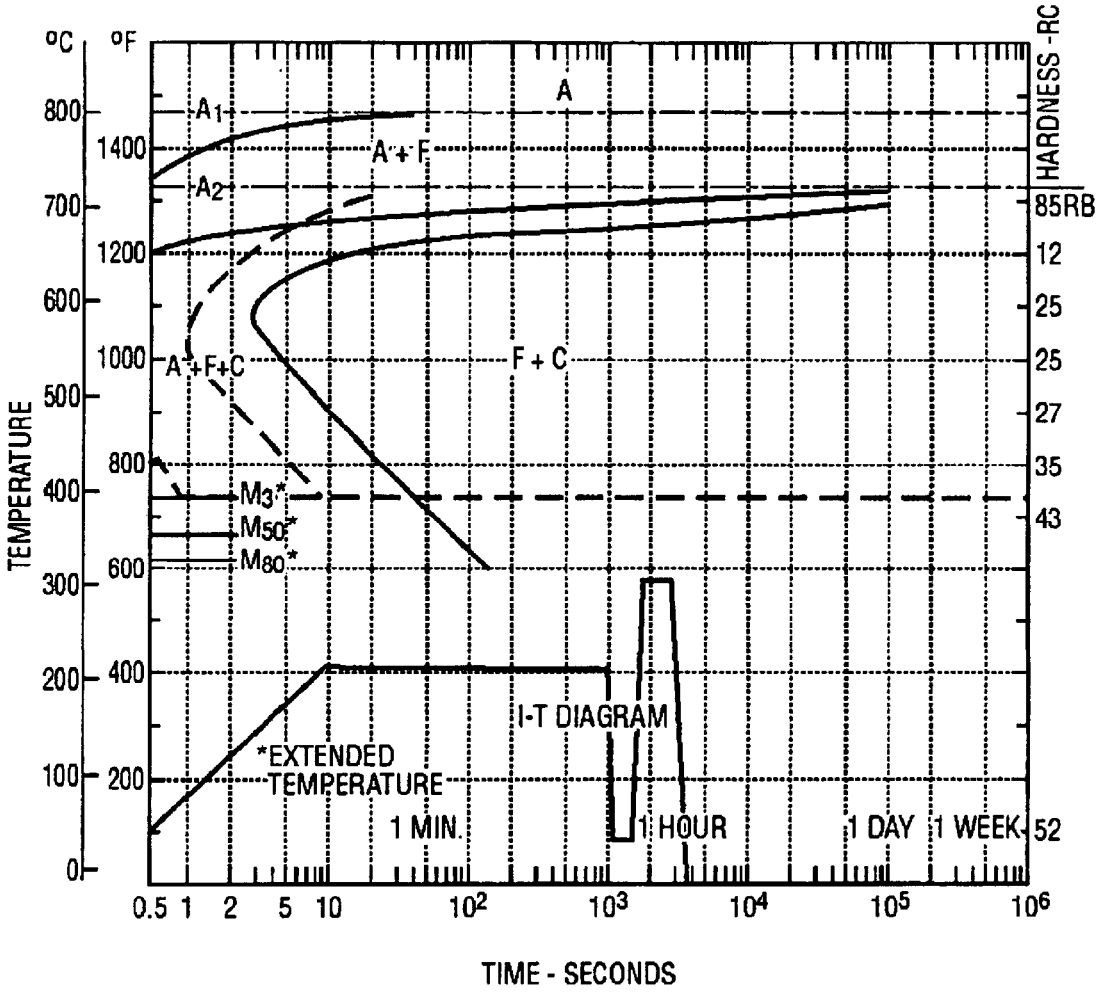
°C
°F
TEMPERATURE
HARDNESS - RC
A
A1
A2
A + F
A + F + C
F + C
M3*
M50*
M80*
I-T DIAGRAM
*EXTENDED TEMPERATURE
1 MIN.
1 HOUR
1 DAY
1 WEEK
85RB
12
25
25
27
35
43
52
0.5 1 2 5 10 10² 10³ 10⁴ 10⁵ 10⁶
TIME - SECONDS

SINGLE-STEP HEAT TREATING AND SURFACE COATING ON SELF-PIERCING RIVETS

BACKGROUND OF INVENTION

1. Field of the Invention

The present invention relates to a method of coating and heat treating self-piercing rivets (SPR) with a coating that resists galvanic corrosion between steel rivets and aluminum panels joined by the rivets.

2. Background Art

In an effort to improve fuel efficiency and reduce environment pollution, an increasing amount of aluminum has been used for structure and body panels in vehicles. In development of aluminum-intensive vehicles (AIV), self-piercing riveting has received increasing recognition as a potentially effective alternative to spot welding for joining aluminum body panels and structures. Currently, commercially available SPR used for AIV are made predominantly of steel.

When steel rivets are used to join aluminum panels, galvanic corrosion may occur especially if the riveted connection is exposed to moisture. To prevent galvanic corrosion, a sacrificial coating is necessitated. In current commercial practice, the coating is applied to the steel rivets after the completion of forming and heat treating. Rivets are heat treated to obtain an appropriate degree of hardness. The desired hardness depends upon the thickness of the panels to be joined, aluminum alloy grade and other design constraints.

Some existing coating materials adopted by the current SPR manufacturers pose various problems, such as possibly inadequate corrosion performance, instability in paint process, and/or the use of toxic substances for passivation. Thus, an alternative coating material and/or process is needed to eliminate these problems.

One proposed solution is to use a coating known as GEOMET® that is available from Metal Coatings International, Inc. of Chardon, Ohio, USA, and Dacral, S.A. of Creil, France. GEOMET® is a chromium-free, water-based VOC compliant coating comprised of overlapping zinc and aluminum flakes in an inorganic binder. Unfortunately, the cure of the coating requires relatively high temperature that may change the mechanical properties of the SPR.

Accordingly, the present invention is directed to the following aspects: (a) eliminating the above problems and, at the same time, (b) achieving the required mechanical properties, (c) improving process efficiency, (d) promoting lean manufacturing and VOC compliance, and (e) enhancing corrosion performance.

SUMMARY OF INVENTION

According to the present invention, heat treating and surface coating process are combined into a single-step process for low carbon steel SPR applied to join 5xxx and 6xxx aluminum panels. In this single-step process, the conventional temper treatment step of the SPR is eliminated. Only a conventional quenching treatment is performed after completely forming the SPR but prior to coating of the steel rivets. The quenching process is carefully controlled to achieve a hardness level greater than 52 HRc (Rockwell "C" scale). In the coating process, a first coat of zinc and aluminum flakes in an inorganic binder is applied to the completely formed and quenched steel rivets. The rivets are subsequently heated to a metal temperature in the range from 350° F. to 450° F. (or from 177° C. to 232° C.) for 15 minutes to set the coating. Then, the second coat is applied and cured at a peak metal temperature in the range from 525° F. to 600° F. (or from 275° C. to 316° C.) for 15 minutes for final cure of both coats.

Depending upon the design requirements and actual steel grade used, the curing temperatures may vary within the ranges specified above with the curing time being slightly adjusted accordingly.

According to other aspects of the invention, the initial hardness of the steel rivets shall be greater than 52 HRc while the coated rivets, after the single-step heat treating and surface coating process, shall attain a microstructure that corresponds to a hardness level around 47 HRc, that is needed for joining 5xxx and 6xxx aluminum panels.

These and other aspects of the present invention will be apparent to one of ordinary skill in the art in view of the attached detailed description of the preferred embodiments below.

BRIEF DESCRIPTION OF DRAWINGS

The FIGURE is a schematic depiction of thermal routes in an I-T diagram.

DETAILED DESCRIPTION

In the present invention, the single-step heat treating and surface coating process begins with conventional steel SPR that has been quenched to a hardness level greater than 52 HRc. The rivets may be coated by commercial dip-spin or spray technique.

One of the potential candidates for the current coating application has been found to be GEOMET® a chromium-free, water based, VOC compliant coating comprised of overlapping zinc and aluminum flakes in an inorganic binder. This coating material is disclosed in U.S. Pat. No. 6,270,884 to Guhde et al., the disclosure of which is hereby incorporated by reference.

In the coating process, a first coat of zinc and aluminum flakes in an inorganic binder is applied to the completely formed and quenched steel rivets. The rivets are subsequently heated to a metal temperature between 350° F. and 450° F. (or between 177° C. and 232° C.) for 15 minutes to set the coating.

The rivets are then cooled and coated with a second coat, and subsequently heated to a peak metal temperature between 525° F. and 600° F. (or between 274° C. and 316° C.) for 15 minutes to final-cure both coats. During this coating and curing procedure, the rivets are effectively exposed to the heat treatment schematically depicted by the thermal routes in the I-T diagram of the attached FIGURE.

Depending upon the design requirements and actual steel grade used, the curing temperatures may vary within the ranges specified above with the curing time being slightly adjusted accordingly.

The initial hardness of the steel rivets shall be greater than 52 HRc while the coated rivets, after the single-step heat treating and surface coating process, shall attain a microstructure that corresponds to a final hardness level around 47 HRc (nominally 46–48 HRc) as required for joining 5xxx and 6xxx aluminum panels. It will be appreciated by one of ordinary skill in the art that depending upon the requirements of a particular fastener application, the hardness of the steel SPR processed according to the present invention may be slightly modified to provide slightly different degrees of hardness.

The single-step heat treating and surface coating process described above eliminates the conventional tempering treatment step used in SPR manufacturing. The elimination of the tempering step leads to energy savings and lean manufacturing. This single-step process along with the application of GEOMET® coating also eliminates the problems associated with current coating systems such as potentially inadequate corrosion performance, instability in paint process, and/or toxic substance for passivation. Some concomitant benefits include the enhanced corrosion performance and compliance with Volatile Organic Compounds (VOC) emission standards.

While the best mode for carrying out the invention has been described in detail, those familiar with the art to which this invention relates will recognize various alternative designs and embodiments for practicing the invention as defined by the following claims.

What is claimed is:

1. A method of combined coating and heat treating of self-piercing rivets, comprising:

providing steel rivets having an initial hardness;

applying a first coating of zinc and aluminum flakes in an inorganic binder to the rivets;

heating the rivets to a peak metal temperature between 177° C. and 232° C. for about 15 minutes;

applying a second coat of zinc and aluminum flakes in an inorganic binder to the rivets;

heating the rivets to a peak metal temperature between 274° C. and 316° C. for about 15 minutes to final-cure both coats and achieve the desired microstructure and corresponding final hardness as required for joining 5xxx and 6xxx aluminum panels.

2. The method of claim 1 wherein the steel rivets begin the process with a hardness of greater than 52 HRc and wherein the single-step surface coating and heat treating process leads to the desired hardness of approximately 47 Hrc.

* * * * *